United States Patent [19]

Gurega

[11] Patent Number: 4,752,188

[45] **Date of Patent: * Jun. 21, 1988**

[54] OIL DETECTION METHOD AND APPARATUS FOR A PUMP SUBMERGED IN A TRANSFORMER VAULT

[75] Inventor: Richard R. Gurega, Easton, Conn.

[73] Assignee: Richal Corporation, Bridgeport, Conn.

[ * ] Notice: The portion of the term of this patent subsequent to Dec. 29, 2004 has been disclaimed.

[21] Appl. No.: 77,500

[22] Filed: Jul. 24, 1987

Related U.S. Application Data

[63] Continuation of Ser. No. 840,315, Mar. 14, 1986, Pat. No. 4,715,785.

[51] Int. Cl.[4] ..... F04B 49/04

[52] U.S. Cl. ..... 417/40; 417/53; 417/1; 417/36

[58] Field of Search ..... 417/1, 36, 40, 44, 45, 417/53; 137/392; 340/603, 620; 73/304 R; 307/118

[56] References Cited

U.S. PATENT DOCUMENTS

| | | | |
|---|---|---|---|
| 1,505,791 | 8/1924 | Lenz et al. | 417/1 |
| 2,463,703 | 3/1949 | Legler | 417/36 X |
| 2,468,791 | 5/1949 | Thomson | 417/1 X |
| 2,910,940 | 11/1959 | Colman et al. | 417/63 X |
| 3,131,335 | 4/1964 | Berglund et al. | 137/392 X |
| 3,181,557 | 5/1965 | Lannan, Jr. | 137/392 X |
| 3,671,142 | 6/1972 | Calabrese | 417/36 |
| 4,019,067 | 4/1977 | Gladstone | 307/118 |
| 4,388,043 | 6/1983 | Preiss | 417/36 |
| 4,437,811 | 3/1984 | Iwata et al. | 417/36 X |
| 4,466,777 | 8/1984 | Kimberlin | 417/36 X |
| 4,586,033 | 4/1986 | Andrejasich | 340/603 |
| 4,595,341 | 6/1986 | Castell-Evans | 417/1 |
| 4,629,398 | 12/1986 | Cahalan | 417/1 |

*Primary Examiner*—Carlton R. Croyle
*Assistant Examiner*—Paul F. Neils
*Attorney, Agent, or Firm*—Kramer, Brufsky & Cifelli

[57] ABSTRACT

A probe is mounted on a water submersible pump housed within a transformer vault. The probe will extend into any water which accumulates in the bottom of the transformer vault enabling a conductive path to be established through an appropriate electric circuit to the pump motor to permit operation of the pump so that the water which is on the bottom of the vault can be safely pumped from the vault. As the water level falls as it is pumped, oily fluids, which are immiscible in the water and will normally rise to a level above the water level in the vault, will come in contact with the probe to form an electrical insulator to inactivate the circuit to disconnect a power source from the pump motor.

5 Claims, 1 Drawing Sheet

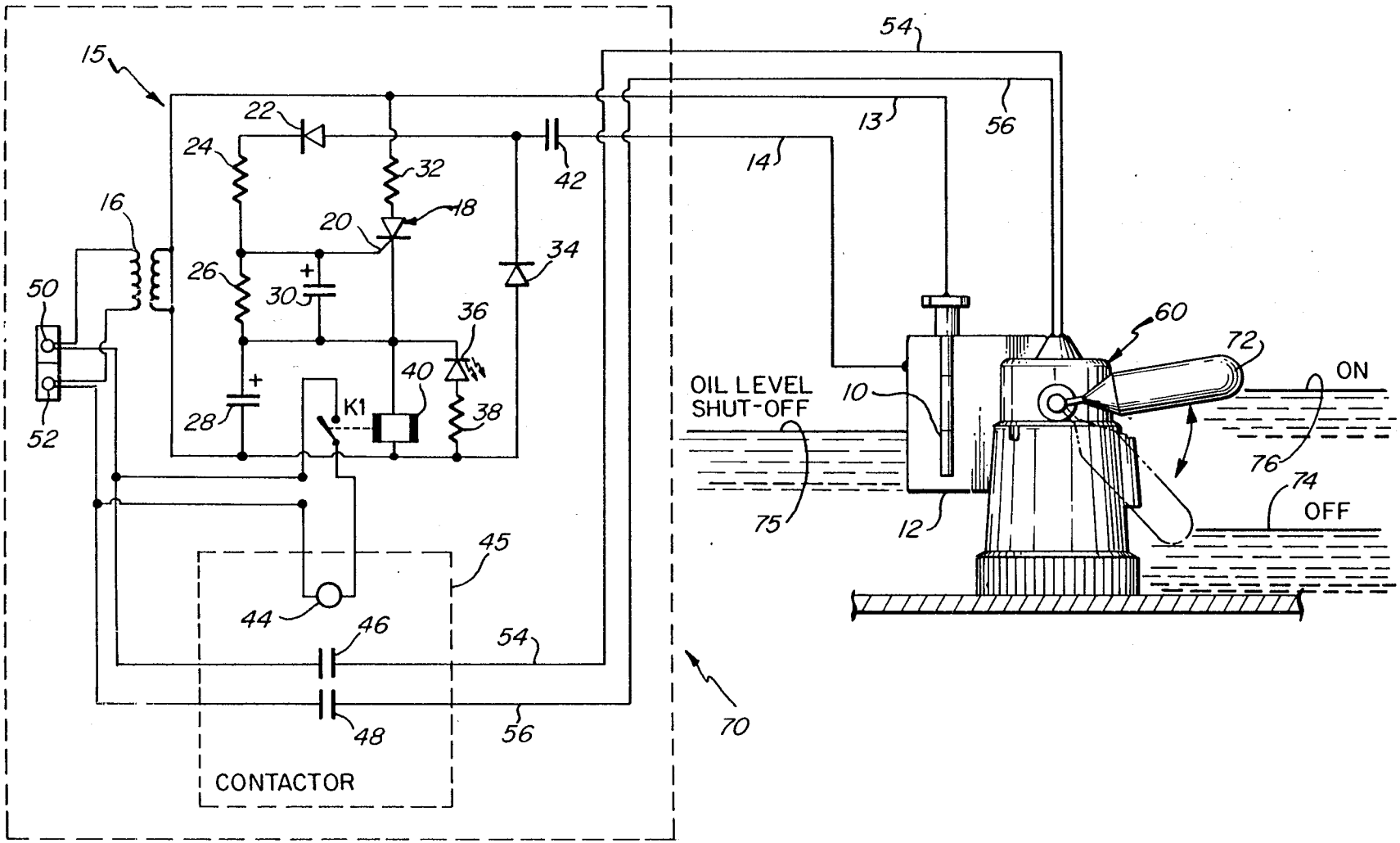
ON
OFF
OIL LEVEL SHUT-OFF
CONTACTOR
K1
10
12
13
14
15
16
18
20
22
24
26
28
30
32
34
36
38
40
42
44
45
46
48
50
52
54
56
60
70
72
74
75
76

OIL DETECTION METHOD AND APPARATUS FOR A PUMP SUBMERGED IN A TRANSFORMER VAULT

This application is a continuation of application Ser. No. 840,315, filed Mar. 14, 1986, now U.S. Pat. No. 4,715,785.

BACKGROUND OF THE INVENTION

This invention relates to an apparatus for detecting the presence of oil in the vicinity of a water submersible pump, and more particularly, an apparatus which will shut down operation of the pump when oil is detected.

Electric utilities commonly use water submersible pumps in transformer vaults for dewatering the vaults. For example, if water accumulates in a transformer vault, it may short a power line causing substantial problems delivering electricity to a consumer. Accordingly, water submersible pumps are commonly placed in the transformer vault to pump out accumulated rainwater and the like which may seep into the vault to maintain the water below a particular level.

Transformers are normally filled with an oily fluid for lubricating and cooling the various components of the transformer. This oily fluid also has a tendency to leak from the transformer housing into the vault. There is a danger to the environment if the oily fluid is pumped with the water into a waste disposal tank or sewer, as such oily fluids usually contain compounds which are harmful to the environment. Further, if the oil admixes with the water and both are pumped to a treatment disposal facility, suitable separation equipment must be provided to separate the oil from the water so that water can readily be disposed of and the oil recycled, or at least stored in a toxic safe facility. Such separation equipment is an item of considerable expense to a utility.

Accordingly, this invention discloses an apparatus which is usable with a water submersible pump of the type used by an electric utility in a transformer vault to insure that only water is pumped from the vault and oil will be left behind. In this manner, the vault can be periodically cleaned to remove the oil alone without the requirement of separating it from water which, as indicated, can be quite expensive. Further, the oily fluids which are removed can be trucked directly to a toxic waste facility, or recycled directly without fear of water contamination.

SUMMARY OF THE INVENTION

In accordance with the invention, a probe is mounted on a water submersible pump housed within a transformer vault. Normally, the probe will extend into any water which accumulates in the bottom of the transformer vault enabling a conductive path to be established through an appropriate electric circuit to the pump motor. This will permit operation of the pump so that the water which is on the bottom of the vault can be safely pumped from the vault. As the water level falls as it is pumped, oily fluids, which are immiscible in the water and will normally rise to a level above the water level in the vault, will come in contact with the probe to form an electrical insulator to inactivate the circuit to disconnect a power source from the pump motor. In this manner, only water is pumped from the transformer vault, which contains a mixture of water and an immiscible oily fluid.

BRIEF DESCRIPTION OF THE DRAWING

Further objects and advantages of the invention will become more apparent from the following description and claims, and from the accompanying drawing, wherein:

The sole FIGURE illustrates an electrical schematic diagram of the oil detection apparatus of the present invention.

DETAILED DESCRIPTION OF THE PREFERRED EMBODIMENT

The present invention relates to an oil detection apparatus 70 including a circuit generally indicated by the numeral 15 adapted to sense the presence of oil at a predetermined level 75 within a transformer vault (not shown) in order to disable or disconnect the motor of a submersible pump 60 housed within the vault to pump rainwater and the like from the vault.

The pump 60 is of standard construction and does not form a part of the present invention. The pump 60 is commercially available and distributed by Richal Corp. and Stancor, Inc. of Brigeport, Connecticut as "Type U6K: Chem-resist" submersible drainage pump.

Normally, a float 72 on pump 60 will ride on any liquid within the transformer vault and will automatically enable the pump motor to be activated by closing a switch in the pump when the level of the liquid within the vault is high as shown at 76 in the FIGURE. This switch will also open to disconnect the pump motor from a power supply connected between contacts 50,52, if the liquid level drops to a predetermined level 74 as indicated in the FIGURE. Float 72 would thus normally serve as a switching device for "on" and "off" operation of the motor of pump 60 in conformance with the liquid level (whether oil, water or a mixture thereof) within the transformer vault, whose operation is controlled by the detection of oil or water between fluid levels 74 and 76.

The pump motor circuit is, however, modified in accordance with the invention by providing a trigger circuit 15 for controlling operation of pump 60. Oil detection apparatus 70 includes an oil probe 10 mounted on the pump 60 to detect the presence of water, and is used to actuate submersible pump 60 via the triggering of circuit 15 to pump water out of the transformer vault.

The oil probe 10 will normally be immersed in oil which insulates the probe from sheet metal wall 12 of the pump housing. However, if water fills the space between probe 10 and the sheet metal wall 12, an electrically conductive path will result. Probe 10 is coupled to circuit 15 via line 13. Sheet metal wall 12 is coupled to circuit 15 via line 14. If circuit 15 detects a conductive path between probe 10 and wall 12, it actuates a motor contactor 45 that couples pump 60 to a power source to enable the pump 60 to turn on.

Circuit 15 includes a thyristor 18 that turns on when a conductive path is established by water between probe 10 and wall 12. When thyristor 18 is on, relay 40 is actuated and, in turn, actuates coil 44 of motor contactor 45. Terminals 46 and 48 on motor contactor 45 supply power to pump 60 via lines 54 and 56. Input power to motor contactor 45 is provided at terminals 50 and 52, which also supply power to circuit 15 via step down transformer 16.

Rectifiers 22 and 34 in circuit 15 convert the AC input voltage to DC for use in powering the thyristor switching circuit. Resistors 24 and 26 form a voltage divider for supplying a proper trigger signal to gate 20 of thyristor 18. Capacitors 42,28 and 30 provide appropriate filtering and resistor 32 limits the current through thyristor 18 in a conventional manner. A light emitting diode (LED) 36 indicates when power is being supplied to pump 60. LED 36 is placed in series with a current limiting resistor 38 across the coil of relay 40.

Any oily fluid in the transformer vault will be immiscible with the water and will seat on top of the water. Accordingly, pump 60 will pump water from the vault until probe 10 is immersed in oil whose level 75 has dropped so that it contacts the bottom of the probe 10, precluding operation of trigger circuit 15 as the oil will form an insulative path between lines 13 and 14. This will cause relay 40 of the trigger circuit to open, deactivating the coil 44 of motor contactor 45. Thus, deactivation of coil 44 will occur simultaneously with the probe 10 sensing that substantially all the water has been pumped from the vault, or if there is no or little oil within the vault, then the circuit will still control the shutdown of operation of the pump as the conductive water level will fall below the probe 10 and housing 12, deenergizing the trigger circuit 15. The pump will become reactivated when water is sensed at the probe 10 before level 76 is reached. Any oil sensed below level 75 will keep the pump deactivated.

What is claimed as new is:

1. Apparatus for pumping water form a transformer vault while leaving lubricating and/or cooling oil floating on said water in said vault, said apparatus comprising:

a pump supported in said vault to pump liquid at a first level;

float means, including a float having a specific gravity less than that of said water and said oil, for activating said pump when said float floats at a second level above said first level;

electrical probe means, supported between said first and second levels, for sensing the electrical conductivity of the liquid at the level of the probe means; and control means responsive to low electrical conductivity sensed by said probe means for deactivating said pump, said low conductivity corresponding to the presence of said oil at the level of the probe means.

2. An apparatus as set forth in claim 1 wherein said float means deactivates said pump when said float floats at a third level between said first level and the level of the probe means.

3. The method of removing water from a transformer vault containing water and oil floating thereon, said method comprising the steps of:

positioning a probe at a fixed level in said transformer vault;

positioning a pump at a fixed level in said transformer vault to extend beneath the level of said probe, said pump being adapted to pump liquid from said vault to an external location;

activating said pump when the water level is above the level of said probe to pump said water from said vault to said external location;

sensing the electrical conductivity of liquid in the vicinity of said probe; and deactivating said pump when the sensed electrical conductivity of the liquid in the vicinity of said probe is relatively low corresponding to the presence of oil in the vicinity of said probe to prevent the pumping of said oil to said external location.

4. A method as set forth in claim 3 further comprising the step of mounting a metallic element to said pump and wherein the step of sensing the conductivity of the liquid in the vicinity of said probe comprises the step of sensing the conductivity of the liquid between said probe and said metallic element.

5. The method of removing electrically conductive water from a transformer vault containing the water and electrically insulative oil floating on the water, without removing the electrically insulative oil, said method comprising the steps of:

submerging in said transformer vault a pump including an electric drive motor to drive the pump, said pump being adapted to pump liquid from said vault to an external location;

mounting a wall member on said pump to extend therefrom;

mounting a probe to said pump;

sensing the electrical conductivity of an electrical circuit comprising said probe, said wall member and the liquid therebetween;

activating the pump drive motor when the electrical circuit has a relatively high conductivity associated with the presence of the electrically conductive water between said probe and said wall member to pump the water to the external location; and deactivating said pump drive motor when the electrical circuit has a relatively low conductivity associated with the presence of the electrically insulative oil between said probe ind said wall member to separate the water from the oil.

* * * * *